United States Patent [19]

Fisher

[11] Patent Number: 4,522,488

[45] Date of Patent: Jun. 11, 1985

[54] CLEANING APPARATUS FOR A MAGNETOGRAPHIC PRINTING DEVICE

[75] Inventor: Almon P. Fisher, Rochester, N.Y.

[73] Assignee: Xerox Corporation, Stamford, Conn.

[21] Appl. No.: 563,854

[22] Filed: Dec. 21, 1983

[51] Int. Cl.[3] ..... G03G 15/08

[52] U.S. Cl. ..... 355/15; 355/3 R; 15/306 A; 15/345; 346/74.2; 360/16; 360/137; 358/301

[58] Field of Search ..... 355/3 R, 15, 1; 15/306 A, 345; 346/74.2; 360/16, 137; 358/301; 118/654

[56] References Cited

U.S. PATENT DOCUMENTS

| | | | |
|---|---|---|---|
| 3,336,904 | 8/1967 | Obuchi | 118/654 |
| 3,906,899 | 9/1975 | Harpavat | 118/654 X |
| 4,010,514 | 3/1977 | Fischer et al. | 15/306 A |
| 4,271,559 | 6/1981 | Blumenthal | 355/15 X |
| 4,277,160 | 7/1981 | Yamada | 355/3 R |
| 4,277,161 | 7/1981 | Calabrese | 355/15 X |
| 4,348,684 | 9/1982 | Binder | 355/15 X |
| 4,361,396 | 11/1982 | Uchida | 355/15 |
| 4,394,086 | 7/1983 | Hoffman, Jr. et al. | 355/3 R |
| 4,435,073 | 3/1984 | Miller | 355/15 |

OTHER PUBLICATIONS

U.S. Patent appln. Ser. No. 515,720 filed Jul. 20, 1983 to R. E. Drews et al.

*Primary Examiner*—A. C. Prescott

*Attorney, Agent, or Firm*—Robert A. Chittum

[57] ABSTRACT

A vacuum cleaning apparatus for a magnetic tape used in a magnetographic printer. The apparatus comprises an elongated nozzle opening in a flat base with a non-conductive screen attached thereto which covers the entire base and nozzle opening. A relatively high vacuum source is connected to the nozzle opening by conduit. The recording surface of the magnetic tape moves in planar contact with the screen in a direction perpendicular to the nozzle opening. Graphite seals are placed at each edge of the screen, the edges with the seals being parallel to the direction of tape movement. The seals direct the flow of air from the upstream and downstream ends of the apparatus to the nozzle opening. The air flow is restricted to that which will flow in and around the woven material forming the screen and along the length thereof to produce a high velocity, turbulent air flow. The high vacuum and low volume of air flow operates quietly and effectively to remove residual toner particles from the tape surface after they have been dislodged by the screen as the tape moves thereby in sliding contact therewith.

10 Claims, 3 Drawing Figures

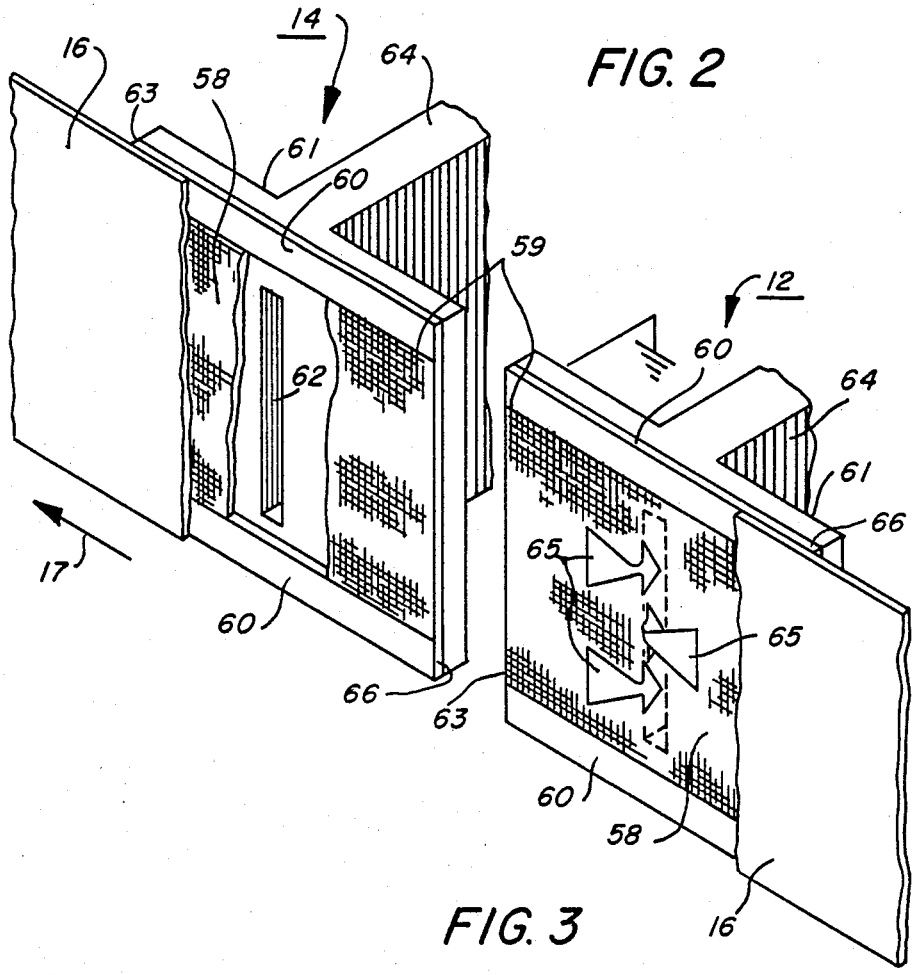
FIG. 2
FIG. 3
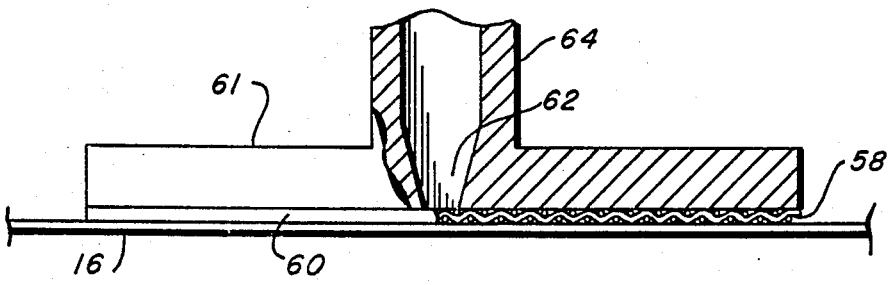

CLEANING APPARATUS FOR A MAGNETOGRAPHIC PRINTING DEVICE

FIELD OF THE INVENTION

The present invention relates to a cleaning apparatus for a magnetographic printing device and more particularly to a vacuum cleaning apparatus for removing residual magnetic toner particles from a magnetic recording tape after the transfer of the developed image therefrom.

DESCRIPTION OF THE PRIOR ART

Removal of residual toner from electrophotographic imaging surfaces has been accomplished by many well known prior art devices. For example, rotating brush cleaners are popular in some existing reproducing machines. Some of the brushes have an electrical bias to enhance cleaning beyond the mechanical scrubbing and flicking action by the brush bristles. The electrical bias may be of a polarity to attract or to repel the charged residual toner left after transfer of the developed image. For one polarity, the toner is attracted to the bristles and must be removed by a similar means. For the other polarity, the toner is repelled away from the bristles as they flick or attempt to flick them off the imaging surface. Still other reproducing machines use blades to plow the residual toner from the imaging surface. Some copying machines use moving web cleaners which have porous, fibrous material pulled from a supply roll by a driven take-up roll, the web being pressed against a charge retentive surface by one or more pressure rollers.

Unfortunately, the magnetic recording surfaces of magnetic tapes used by magnetographic printing machines are more receptive to abrasion than electrophotographic imaging surfaces and generally require more thorough cleaning. Consequently, blade cleaners cannot be used to clean magnetic recording surfaces because they damage the surface, and brush cleaners cannot be used because they do not remove enough residual magnetic toner. Because of the high cleanliness required for magnetic tape in an operating environment, web cleaners by themselves would be impractical because of the quantity of residual magnetic toner to be removed. In order to effect the proper cleaning, the amount of web material consumed would be too costly and too bulky.

U.S. Pat. No. 4,010,514 to J. Fischer et al. discloses the use of a pair of fibrous, non-woven material ribbons guided over hollow, rotatable suction rolls to clean a tape. These suction rolls have holes therein and are arranged to place the ribbons into contact with each side of the tape. The ribbons are each moved from supply to take-up rolls very slowly relative to the tape movement and in the opposite direction. Particles removed by the ribbons are generally sucked through the ribbon into the suction rolls through the holes therein. Stationary evacuation ducts inside the suction rolls remove the particles extracted from the ribbons.

SUMMARY OF THE INVENTION

It is the object of this invention to clean the magnetic recording surface of a moving magnetic tape in a magnetographic printing device and to effect the cleaning continually during movement of the tape through the processing stations of the device without damaging or reducing the operating life of the recording surface.

It is another object of this invention to clean the magnetic recording surface by a vacuum from an elongated slot while preventing the tape from flexing or being sucked into the vacuum slot.

It is still another object of this invention to clean the recording surface of the magnetic tape in a quiet, low-noise manner by using a high vacuum but low volume of air flow.

It is a further object of this invention to clean the recording surface of the magnetic tape with a high vacuum from a nozzle slot and with a low-air flow which moves through spaces in a non-conductive planar screen, the general direction of the air flow being parallel to the plane of the screen and in and around the woven material making up the screen. The screen is sandwiched between the tape and a parallel base having the nozzle slot to create a turbulence in the air flow for carrying and evacuating the residual magnetic toner from the tape surface to and through the nozzle slot. Concurrently, the toner is disturbed or relocated on the tape recording surface by the screen as the tape moves thereby and in contact therewith.

It is yet another object of this invention to direct the flow of turbulent air from opposite ends of the screen towards the nozzle slot and prevent the movement of the air in directions perpendicular to the tape movement direction by elongated and grounded graphite seals at the side edges of the screen.

The present invention relates to a vacuum cleaning device for removing residual toner particles from the recording surface. Though also useful for cleaning belt-type photoreceptors in electrophotographic printers, this invention is particularly useful for removing residual toner particles from magnetic tape in a magnetographic printer In the preferred embodiment, two vacuum cleaning devices are used in series. One such cleaner could be used effectively, however, by itself as either a bulk cleaner or as a secondary cleaner to a bulk cleaner of another type. When two cleaners are used, the first cleaner in the series is essentially a bulk cleaner which removes residual toner particles from the recording surface to a cleanliness level of about 2 particles per square millimeter. If this level of cleanliness is sufficient, only one vacuum cleaner is required. The second cleaner in the series is used as a secondary cleaner which removes the toner particles from the recording surface to a cleanliness level of about 0.4 particles per square millimeter. The difference between the two vacuum cleaning devices is the width of the elongated vacuum nozzle or slots. The first, bulk cleaning device has a nozzle slot width of approximately $\frac{1}{8}$ inch whereas the second cleaning device in the series has a nozzle slot width of approximately 1/16 inch. This nozzle size difference is only one of many different ways, of course, to vary the air flow and suction on the tape.

The cleaning device comprises an elongated nozzle or nozzle slot to which a vacuum source is connected via a conduit. The nozzle slot is constructed through a flat base to which a non-conductive screen is attached. The screen material may be plastic or any plastic-like material. Graphite seals are formed on the side edges of the screen which are parallel to the moving direction of the magnetic tape. The seals are of the same thickness as the screen and may be individual elements which are separate from the screen and attached thereto or integral therewith. The cleaning device bases are coplanar and the screens thereon slidingly contact the magnetic tape as it moves therepast. The graphite seals of at least one of the cleaning devices are electrically grounded. The purpose of the seals is to prevent the flow of air perpendicular to the tape movement direction. This forces the air to flow in and around the woven material making up the screen. The direction of air movement is parallel to the direction of tape movement but, since the air enters the device screen from opposite ends of the device base, the air approaches the nozzle slot from opposing directions.

As the tape moves past each cleaning device, toner particles are dislodged and carried away by the high velocity, turbulent air flow that exits through the screen. The nozzle slot is located closer to the downstream or tail edge of the device than the upstream or lead edge, so that a higher velocity air flow is generated at the tail edge for more effective cleaning of the tape as it moves thereby.

BRIEF DESCRIPTION OF THE DRAWINGS

FIG. 2 is a partially sectioned, perspective view of the magnetic tape cleaning apparatus.

FIG. 3 is a partially sectioned, side view of the magnetic tape cleaning apparatus.

DECRIPTION OF THE PREFERRED EMBODIMENT

Figure 1:
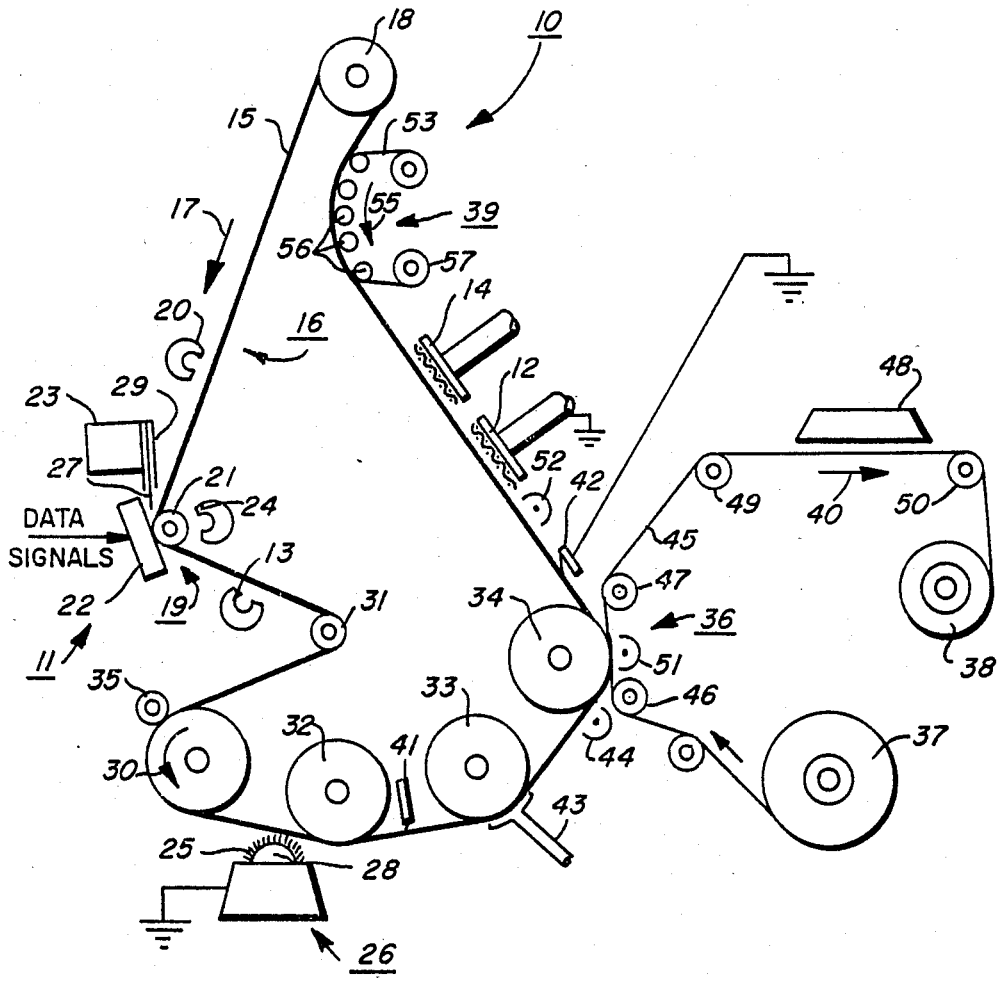
FIG. 1 is a schematic diagram of an elevation view of a thermoremanent magnetic printing system incorporating the magnetic tape cleaning apparatus of the present invention.

Referring to the system diagram of FIG. 1, there is shown a thermoremanent magnetic printing system 10 which incorporates the magnetic tape cleaning apparatus 12, 14 of the present invention, more fully described later. Though a thermoremanent printing system is shown, the cleaning apparatus 12, 14 could be used in any printing device utilizing a moving latent image recording medium in which the latent image is developed by dry toner from a toner applying means.

The printing system 10 includes a series of process stations through which a magnetic recording medium in the form of an endless tape 16 passes. Although the preferred embodiment uses an endless tape configuration for the recording medium, various other configurations (not shown) could be used equally as well, such as, for example, one having a supply roll and a take-up roll which may be rewound on the supply roll from the take-up roll and reused when the supply is depleted.

One of the preferred choices for the magnetic recording medium 16 is a magnetic tape having a chromium dioxide recording surface 15 sold under the trade name Croyln® by the E. I. DuPont Company, Wilmington, Delaware. The curie point of Crolyn is about 132° C., which is low enough to provide excellent results in a thermoremanent magnetic imaging environment.

Beginning with the print or imaging station 11, the magnetic tape 16 proceeds in the direction of arrow 17 consecutively past erase magnet 13, developing station 26, transfer station 36, cleaning apparatus 12, 14 web cleaner 39, steering roller 18, pre-magnetization magnet 20, and back to the imaging station. The development station and transfer stations are typical stations well known in the prior art. The imaging station may comprise any magnetic image producing means or, as depicted in this configuration, a thermoremanent magnetic imaging station of the type disclosed in copending U.S. application Ser. No. 515,720 filed July 20, 1983 to R. E. Drews et al. and assigned to the same assignee as this invention. Accordingly, this commonly assigned application of R. E. Drews et al. is incorporated herein by reference.

Steering roller 18 is the upper most roller of plurality of rollers, more fully discussed later, around which the endless tape 16 travels. The steering roller is adjustable about its axis to keep the tape centered on the rollers, so that it does not gradually travel or "walk" off of them as the tape moves along its endless path. This steering roller 18 may be adjusted manually or automatically by means well known in the belt tracking prior art.

Pre-magnetizing magnet 20 places a magnetization of one polarity on the tape recording surface 15 prior to entrance of the tape 16 into a nip 19 formed by a thermal printhead 22 and a pressure roller 21. A printhead cleaner 23 is periodically actuated to keep the printhead 22 free of developing material and other debris that tends to accumulate thereon during the printing operation of system 10.

The imaging station 11 comprises a thermal printhead of the type having a linear array of individually addressable heating elements which contact the recording surface 15 as the tape 16 containing the surface moves thereby. Pressure roller 21 is adjustable along a plane containing the line of contact between the heating elements and the tape and the axis of the pressure roller, so that the pressure roller selectively urges the belt surface 15 into the heating elements at a desired lineal force. The force of contact by the heating element of the printhead 22 on the imaging surface 15 may vary from 0.1 to 6 pounds per lineal inch (pli), but the preferred range is 0.4 to 4 pli. Several commercially available thermal printheads perform thermoremanent magnetic imaging very well. One is marketed by the Rohm Corporation under the description Rohm Kh-106-6 and another is a 300 individually addressable heating elements per inch printhead sold by the Mitsubishi Electric Corporatin of Japan under the designation S-215-12.

The latent magnetic image is produced by energizing selected thermal heating elements with data signals such as digitized information signals from a typical character generator, computer or charged coupled device (CCD) scanner (not shown). Each heating element of the printhead 22 is capable of heating small areas or pixels of the imaging surface 15 above the curie point of the surface medium in the presence of a magnetizing field produced by permanent magnet 24 of opposite polarity to that of the pre-magnetizing magnet 20.

The pre-magnetization of surface 15 by magnet 20 is erased in the heated pixels and the magnetizing field of magnet 24 is able to induce a magnetism in the pixels having an opposite polarity to that of the pre-magnetization. The magnetic field strength of magnet 24 is smaller that that of the pre-magnetizing magnets 20, so that the pre-magnetization of the recording surface 15 will not be affected except in the heated pixels. The actuation time of the heating elements in conjunction with the surface speed of the belt enables the heated pixels to cool, while still in the magnetic field of magnet 24, thus freezing the polarity switched magnetization regions in the pixels. The opposing magnetization of the pixels in the pre-magnetization background area form fringe fields in image configuration, that is, the latent magnetic image, and hold magnetic toner particles 25 applied to the latent image at the developing station 26.

The printhead cleaner 23 is also located at the imaging station 11. It reciprocally moves a portion of a planar cleaning material 27 that is held between two parallel plates 29 through the nip 19 and withdraws it to keep the printhead clean. This prevents degraded latent magnetic images from being formed because of poor contact by the printhead heating elements with the recording surface 15. The means for moving the cleaning material 27 periodically into and out of the nip 19 from the guide plates 29 may be by any well known means such as by a tractor wheel (not shown).

Downstream of the printhead 22 is an erase magnet 13 for erasing either the latent magnetic image or both the latent magnetic image and the pre-magnetization background regions. If multiple copies of a one of the latent images is desired, then the pre-magnetizing magnet 20, nip magnet 24 and erase magnet 13 must be relocated to a position so that their magnetic fields do not disturb the existing latent magnetic image and, of course, the printhead de-energized.

Next, a graphite-covered, adjustable roller 31 is used to maintain a predetermined tension on the tape 16. Drive roller 30 is rotated by any convenient means for imparting a constant velocity to the tape, such as, a constant speed electric motor (not shown). Pinch roller 35 squeezes the tape against the drive roller 30 to minimize the slippage of the tape as it is being driven by drive roller 30.

The developing station 26 comprises a magnetic brush 28 which applies magnetic toner 25 to the latent magnetic images as they pass thereby on the tape surface 15. The average toner particle diameter is generally between 8 and 16 μm. Agglomerates up to the effective diameter of 30 μm may be present without reducing printing quality or cleaning station effectiveness. The magnetic brush is grounded to prevent electrostatic or triboelectric charges from building up in the toner. The tape is also grounded at a position after transfer of the developed image by sliding graphite contacts 42 which assist in further reducing background in the developed magnetic images and enhance tape cleaning by the cleaning apparatus 12, 14 and cleaning web 39.

Idler rollers 32, 33 and 34 assist in maintaining belt tension and preventing belt slippage. A blade cleaner 41 is optionally available for removing any toner 25 that may settle on the back side of the tape 16 (opposite surface 15) from the developing station 26 during the development process. A vacuum nozzle 43 in the shape of an elongated slit is positioned closely adjacent, but spaced from, the tape recording surface 15 at idler roller 33 to remove unwanted background toner which may have settled in the background regions of the developed image during development thereof at the developing station 26.

Transfer of the developed image is effected at idler roller 34 by electrostatic transfer. This is accomplished by placing an electrostatic charge on the toner 25 of the developed image by a precharge corona generating device 44. The developed image receiving medium, such as paper 45, is provided by a web from supply roll 37 which is pulled through the transfer position at idler 34, past idler rollers 46, 47 and 49, radiant fuser 48, and on a take-up roll 38 by capstan drive roller 50 and capstan drive means (not shown).

Idler rollers 46, 47 cause the paper 45 to contact the tape 16 as it travels around idler roller 34 for an arcuate length as the capstan drive roller 50 pulls the paper through the transfer station 36 in the direction of arrow 40 and at the same velocity as the tape 16 is traveling. A second corona generating device 51 places a charge of opposite polarity to that of the precharge corona generating device 44 and on the side of the paper 45 that is opposite to the one contacting the tape 16 to effect electrostatic transfer of the developed image from the tape to the paper.

As mentioned above, sliding graphite contacts 42 providing a means to ground the tape 16 after the developed image has been transferred. The contacts 42 are fixed and continually maintain sliding contact with the tape recording surface 15 as the tape moves thereby.

After the tape grounding contacts 42, an alternating current corona generating device 52 places a neutralizing a.c. charge on the residual toner particles 25 that were not transferred at the transfer station 36. This charge neutralization and previous tape grounding by contacts 42 assist the cleaning apparatus 12, 14 in removing a majority portion of the residual toner 25. Web cleaner 39 substantially removes the remaining residual toner. The web cleaner comprises a porous material 53 slowly pulled from a supply roll 54 in the direction of arrow 55 past a plurality of idler rollers 56 by driven take-up roll 57. The direction of movement of the web is opposite to that of the tape 16 and moves much slower than that of the tape. By using several idler rollers to press the web against the tape recording surface 15, several different portions of the web contact the recording surface with the last contact point cleaning the tape with the least amount of residual toner.

The cleaning apparatus of the present invention is best observed with reference to FIGS. 2 and 3. In FIG. 2, the portion of the tape 16 contacting the cleaning apparatus 12, 14 has been removed. Though two nearly identical cleaning apparatuses are shown, one could be used. Each apparatus 12, 14 comprising a non-conducting woven material 58 with openings or having interstices therein such as, for example, a plastic screen. Thus, the plastic material is in the nature of fibers which are woven such that the fibers which are parallel to each other are spaced apart the distance of between 2 and 10 fiber diameters. The fiber diameter of the woven material in the preferred embodiment was 10 mils, with the acceptable diameter range being between 5 and 15 mils. Commercially available plastic screen having a fiber diameter of about 10 mils and a parallel spacing of 60 mils has been found to work very well. On each edge 59 of the woven material or screen 58, a graphite seal 60 is constructed, that is, parallel with the direction of movement of the tape 16; i.e., in the direction of arrow 17. The seals 60 are approximately ½ wide and extend for the length of the cleaner base 61, so that the flow of air into elongated nozzle 62 in the base 61, must be through both ends of the screen as shown by arrows 65 because the graphite seals 60 prevent the entrance of air along the edge 59. The flow of air through the screen 58 and the sealing of the moving tape 16 by the graphite seals 60 are produced by a vacuum source (not shown) which is connected to the elongated nozzles 62 by conduits 64. The distance from the screen ends 63 to the nozzle 62 is about ¾ inch and the distance from the other screen ends 66 to the nozzle 62 is about one inch. A vacuum applied to the nozzles is in the range of 16 to 20 inches of water, with the preferred vacuum being about 18 inches of water. A higher vacuum causes the tape 16 to be drawn or sucked against the screen 58 with a force that causes too much friction between the moving tape and the screen. Such high force damages the recording surface 15. If the vacuum is lower than 16 inches of water, the tape is not maintained in intimate contact throughout the area of the screen and the tape is not held tightly enough along the seals 60, so that adequate vacuum cleaning is achieved. The distance of the downstream end 63 of the screen 58 and base 61 to the nozzle slot 62 is shorter than the distance of the upstream end 66 of the screen and base. This provides a higher velocity in the air flow of the tape exit and results in more effective cleaning.

When two cleaning apparatuses 12 and 14 are used, the nozzle width for the first one may be approximately ⅛ inch and the length which is perpendicular to the tape direction, is that required to run the distance between the graphite seals 60. The tape width, of course, determines the elongated nozzle length. The second cleaning apparatus 14 is identical to the first except that the nozzle width is about one half that of the first; viz., 1/16 inch. At least the graphite seals of the first cleaning apparatus 12 are grounded. Both vacuum conduits 64 may be connected to the same vacuum source and the two cleaning apparatuses should generally be spaced from each other by not more than one to a few inches. When these two cleaning apparatuses are used in series, the first one reduces the residual toner 25 by about a factor of 10 and the second one reduces the residual toner 25 by about another factor of 10. The cleanliness level of the tape surface is about 2 particles per square millimeter after cleaning by the first vacuum cleaning apparatus 12 and about 0.4 particles per square millimeter after cleaning by the second cleaning apparatus 14. Although not shown, the air entrained toner particles 25 could be gathered in a baffled settling chamber downstream from the nozzles 62 and reused. A filter (not shown) would collect all toner from the air not settled in the baffled chamber prior to being exhausted to the atmosphere.

The physical movement of the residual toner particles by the screen dislodges the toner particles from what is referred to as an "energy well." It has been found that moving the toner particles along the surface to which they are attached by the distance of least their diameter enables their removal by vacuum cleaning. The air turbulentance caused by the flow of air around the woven structure or openings prevents the toner particles from coming to rest long enough to achieve energy stability and re-enter an energy well which resists vacuum extraction.

Vacuum extraction of the majority of the residual toner is most attractive because most other means, such as blades, tend to damage the recording surface of the tape. Brush cleaners cannot remove enough residual toner and web cleaners alone would require the consumption of too much web material and probably cause too much drag on the tape.

In recapitulation, the vacuum cleaning device of the present invention provides a high vacuum but low volume of turbulent air lengthwise through a non-conductive woven material such as a plastic screen. A nozzle slot is provided in a planar base and is attached to a vacuum source via an interconnecting conduit. The plastic screen is attached to the side of the base opposite to the one with the conduit attached to the nozzle, so that the screen lies flat on the base side and covers the nozzle slot. To obtain a high level of cleanliness, two vacuum cleaning devices are used in series along the tape path, so that the screens lie in a common plane. This prevents the tape from flexing as it moves therepast in contact therewith. Graphite seals on the edges of the screen parallel to the direction of tape movement prevents the flow of air from the tape edges through the screen to the nozzle slot. At least, one of the devices has its seals electrically grounded. The distance of the downstream end of the base and screen to the nozzle slot is shorter than the distance of the upstream end of the base and screen, so that there is higher velocity in flow at the tape exit for more effective cleaning.

When two of the cleaning devices of the present invention is used, the first should be used as a bulk toner particle remover and the air velocity may, accordingly, be lower and still effective for this purpsoe. Accordingly, the upstream most cleaning device may have a nozzle slot width which is of greater width than that of the downstream cleaning device.

The advantages of such a tandom of cleaning devices is that the devices do not cause flexing of the magnetic tape as it moves thereby because the cleaning surfaces which contact the tape are flat and gentle on the recording surface. The plastic screen does not damage or abrade the recording surface and the lack of tape flexure increases its operating lifetime. The screen prevents the tape from being sucked into the nozzle slot and the pressure on the moving tape that is normal thereto because of the vacuum is slight when compared with other cleaning methods. Because the cleaning devices use a high vacuum and low volume of air the devices operate very quietly. Electrostatic charge on the tape is controlled by grounding the seals of at least one of the devices. Additional grounding of the tape is provided at an upstream location from the cleaning devices. Prior to passage of the tape past the cleaning devices, an AC corona discharge is applied to the residual toner particles to neutralize any charges thereon.

Many modifications and variations are apparent from the foregoing description of the invention and all such modifications and variations are intended to be within the scope of the present invention. This cleaning device has been described as being used in a magnetographic printer but would be equally applicable for cleaning a flexible photoreceptor belt of an electrophotographic printing device or copier.

I claim:

1. An apparatus for cleaning residual toner particles from the recording surface of a flexible, image retentive member used in a printing device, the cleaning apparatus comprising:

a fixed base having a flat surface with an elongated nozzle opening therein, the base having opposing edges which are substantially perpendicular to the longer direction of the nozzle opening and opposing ends which are substantially parallel with the longer direction of the nozzle opening;

a vacuum source connected to the nozzle opening;

a layer of uniformly thick, non-conductive, woven material having interstices therein, the layer having parallel edges and being attached to the base flat surface, so that it covers the flat surface and the nozzle opening therein with the layer edges being perpendicular to said longer direction of the nozzle opening;

the recording surface of the image retentive member being moved in full sliding contact with the layer and in a direction parallel to the layer edges and perpendicular to the nozzle opening; and seals being placed along the opposing edges of the layer and adjacent the base edges to form air seals between the moving image retentive member and the base surface, so that the flow of air through the layer interstices produced by the vacuum source is directed from each of the oposing ends of the base to the nozzle opening to remove residual toner particles dislodged by the image retentive member moving relative to and in contact with the layer.

2. The apparatus of claim 1, wherein the woven material of the layer is plastic and the seals are graphite.

3. The apparatus of claim 2, wherein the layer of plastic woven material is a plastic screen.

4. The apparatus of claim 3, wherein the graphite seals are electrically grounded.

5. The apparatus of claim 4, wherein the vacuum source produces a vacuum in the range of 16 to 20 inches of water and wherein the apparatus further comprises an AC corona generating device upstream of said fixed base for neutralizing any electrostatic charge that might build up on the residual toner.

6. The apparatus of claim 4, wherein the distance from the upstream end of the fixed base to the nozzle opening is longer than the distance from the downstream end of the fixed base to the nozzle opening, so that a higher velocity of turbulent air flow is produced through this portion of the plastic screen interstices to provide more effective cleaning of the image retentive member as it exits the cleaning apparatus.

7. The apparatus of claim 6, wherein the nozzle opening width is between $\frac{1}{8}$ and 1/16 inch and wherein the upstream distance between the base end and the nozzle opening is about one inch and the downstream distance is about $\frac{3}{4}$ inch.

8. The apparatus of claim 7, wherein the nozzle opening is a slot and wherein the image retentive member is a magnetic tape.

9. An improved cleaning station for a magnetographic printing machine of the type having a movable, endless magnetic tape with a recording magnetic surface, which tape is moved by stationary imaging, development, transfer and cleaning stations, the imaging station having a fixed recording head which records latent magnetic images on the magnetic tape in response to digitized data received thereby as the magnetic tape moves therepast, the development station having means for applying toner particles to the latent magnetic image to develop the images and the transfer station having means for transferring the developed images to a permanent record medium as the magnetic tape continues its movement respectively therepast prior to its passing by the cleaning station whereat the residual toner particles are removed on its return to the imaging station, the improved cleaning station comprising:

at least one fixed support having a flat surface with a nozzle slot therein, the nozzle slot being perpendicular to the magnetic tape movement direction, the support having opposing edges which are substantially perpendicular to the nozzle slot and opposing ends which are substantially parallel with the nozzle slot;

a vacuum souce connected to the nozzle slot so that a suction is applied to the magnetic tape as it moves by the support;

a sheet of non-conductive, woven plastic material having interstices therein, the sheet having parallel edges and being attached to the support flat surface, so that it covers the flat surface and the nozzle slot therein with the sheet edges being perpendicular to said nozzle slot, the sheet of woven plastic material being positioned between the support flat surface and the moving magnetic tape in order that the sheet may dislodge and relocate the residual particles while simultaneously preventing damage to the tape recording surface of the magnetic tape as the tape slides against the sheet under the suction from the nozzle slot; and graphite seals positioned along the sheet edges to form air seals between the moving magnetic tape and the support surface, so that a flow of air through the sheet interstices, which is produced by the vacuum source, is directed from each of the opposing ends of the support to the nozzle slot in order to remove the dislodged residual toner particles from the magnetic tape.

10. The improved cleaning station of claim 9, wherein the seals are electrically grounded, and wherein the cleaning station further comprises:

an a.c. corona generating device upstream of the support for neutralizing any electrostatic charge that might build up on the residual toner particles; and a graphite contact in sliding engagement with the recording surface of the magnetic tape positioned upstream of the a.c. corona generating device for electrically grounding the magnetic tape.

* * * * *